US008235575B2

(12) United States Patent
Kim

(10) Patent No.: US 8,235,575 B2
(45) Date of Patent: Aug. 7, 2012

(54) LED LIGHT BOARD

(75) Inventor: Moon-Soo Kim, Gyeonggi-do (KR)

(73) Assignee: Feelis Co., Ltd., Gyeonggi-do (KR)

( * ) Notice: Subject to any disclaimer, the term of this patent is extended or adjusted under 35 U.S.C. 154(b) by 0 days.

(21) Appl. No.: 13/183,236

(22) Filed: Jul. 14, 2011

(65) Prior Publication Data

US 2012/0092892 A1 Apr. 19, 2012

(51) Int. Cl.
*F21V 8/00* (2006.01)
*F21V 15/015* (2006.01)

(52) U.S. Cl. ..... 362/633; 362/362; 362/612

(58) Field of Classification Search ..... 362/362, 362/367, 612, 632–634; 349/58; 40/546, 40/564, 571, 610, 782–785
See application file for complete search history.

(56) References Cited

U.S. PATENT DOCUMENTS 4,862,612 A * 9/1989 Sugihara et al. ..... 40/782
5,732,496 A * 3/1998 Tanaka ..... 40/784
6,141,926 A * 11/2000 Rossiter et al. ..... 52/239
6,991,349 B2 * 1/2006 Wang ..... 362/362
7,043,881 B2 * 5/2006 Krause et al. ..... 52/171.3
7,665,879 B2 * 2/2010 Hsieh ..... 362/633
8,021,032 B2 * 9/2011 Pei ..... 362/612
2007/0177391 A1 * 8/2007 Davis et al. ..... 362/367

FOREIGN PATENT DOCUMENTS

GB 2161638 A * 1/1986
KR 10-0700730 3/2007
KR 10-0947657 3/2010
KR 20-2010-0007684 7/2010

* cited by examiner

*Primary Examiner* — Alan Cariaso
(74) *Attorney, Agent, or Firm* — Fulbright & Jaworski L.L.P.

(57) ABSTRACT

Disclosed is a light emitting diode (LED) light board. The LED light board includes: a light guide panel (LGP) shaped as a rectangle; an LED module disposed at a lateral side of the LGP and including a plurality of LEDs; a first frame having the LED module embedded therein and coupled to one side of an edge of the LGP; a second frame coupled to the other side of the edge of the LGP perpendicular to both ends of the first frame; and a corner finishing end on which the first frame and the second frame are connected to each other and corners of the first frame and the second frame are finished. The first and second frames include a sidewall formed at one edge of the LGP, an upper wing bent on an end of a sidewall, and a lower wing bent on the other end of the sidewall.

4 Claims, 6 Drawing Sheets

[figure 1]
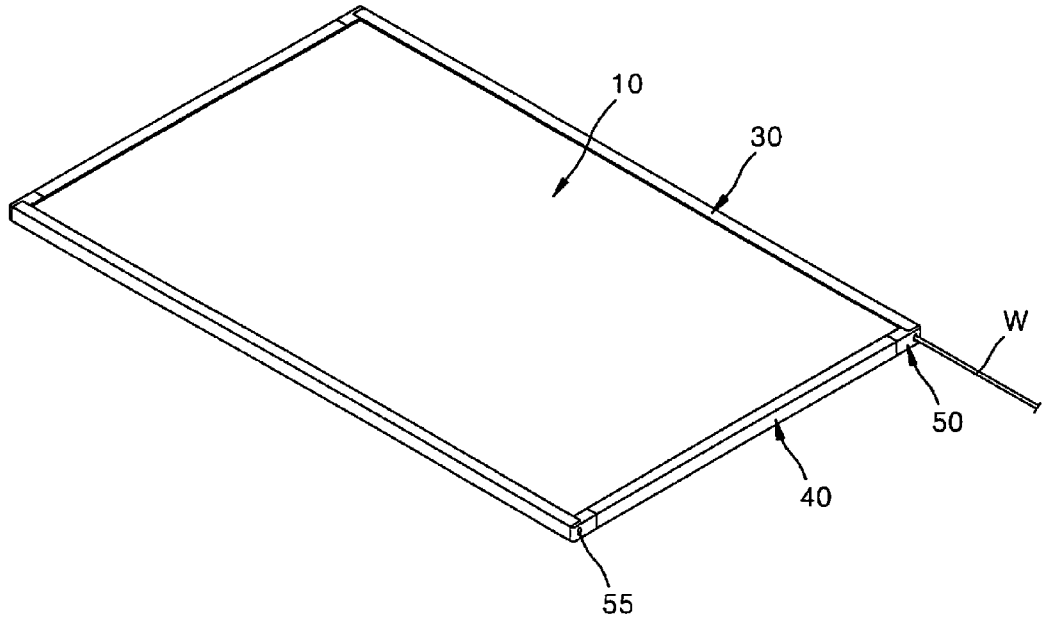
[figure 2]
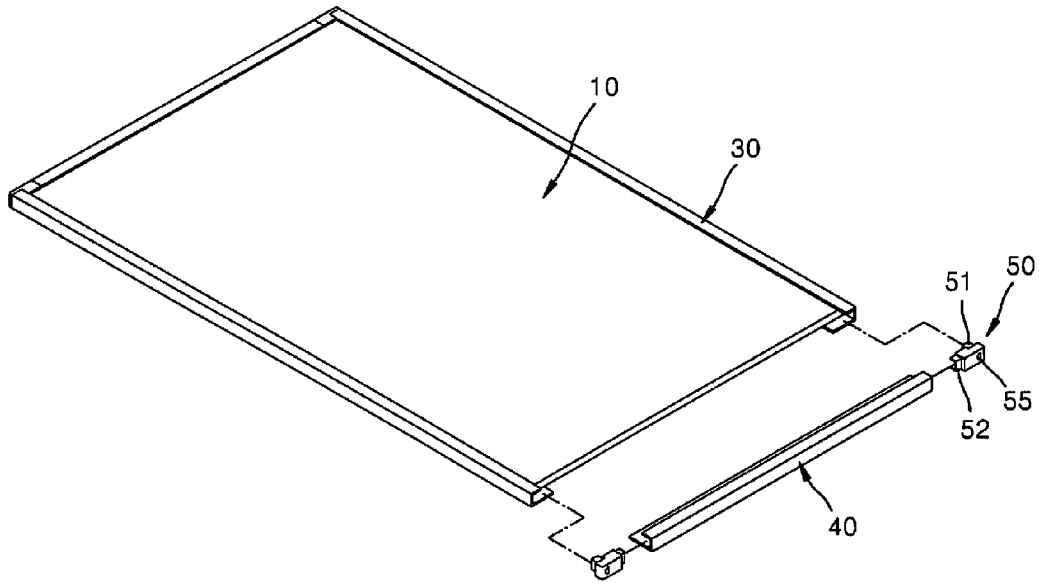

[figure 3]
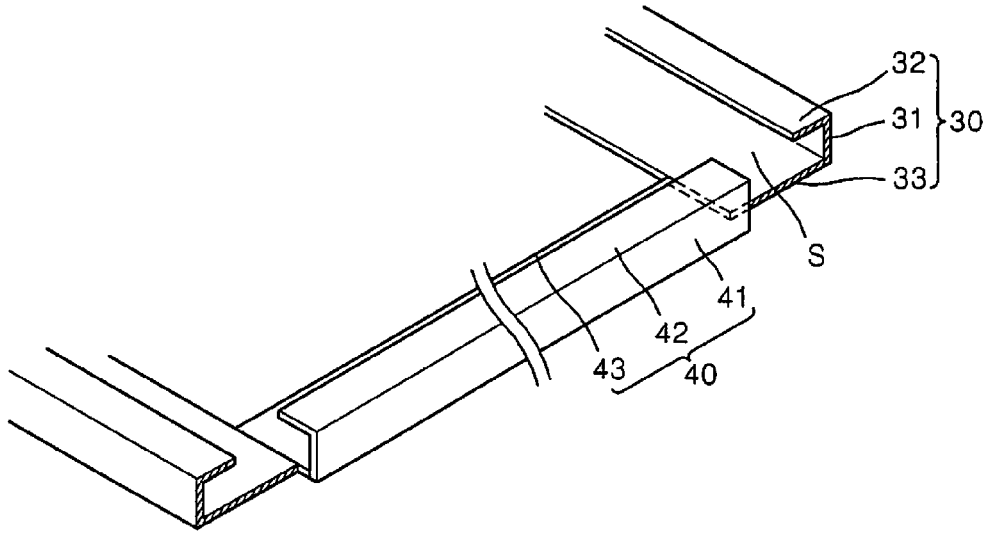
[figure 4]
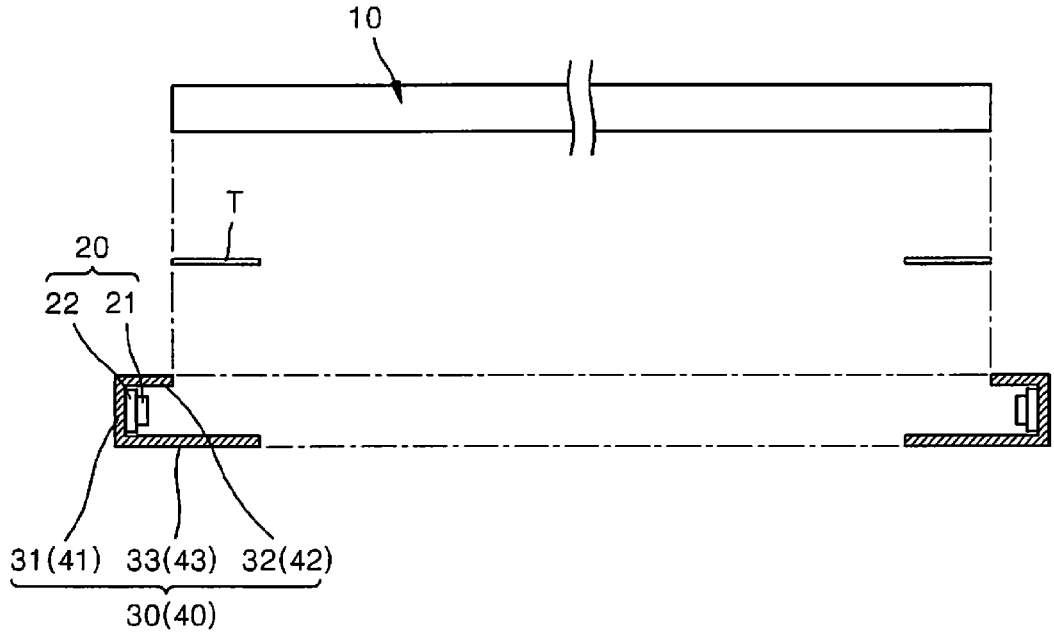

[figure 5]
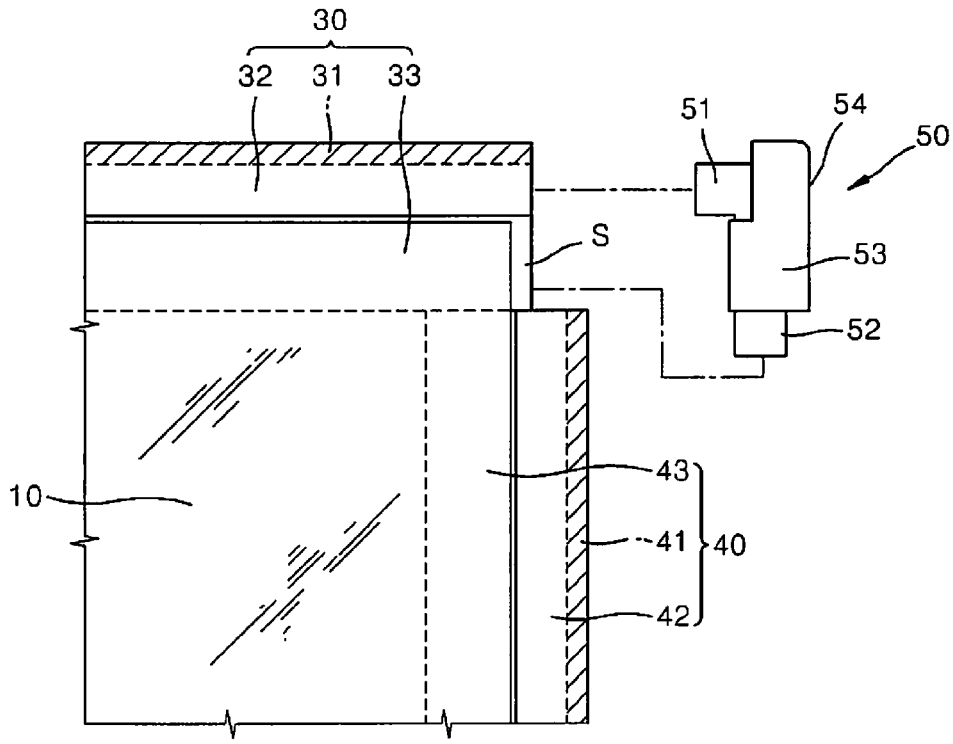
[figure 6]
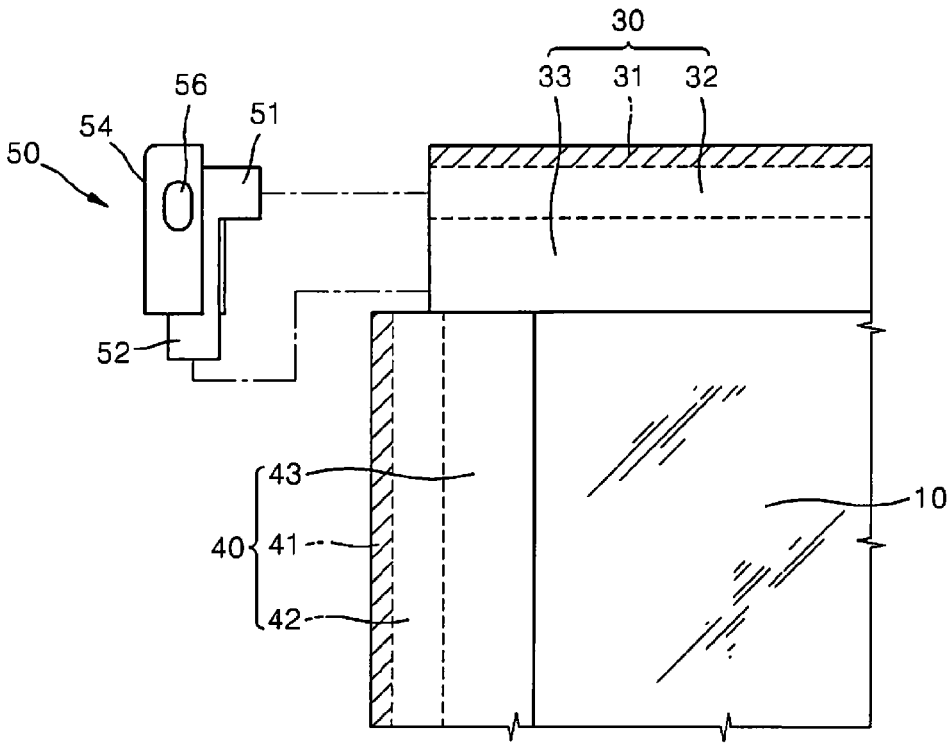

[figure 7]
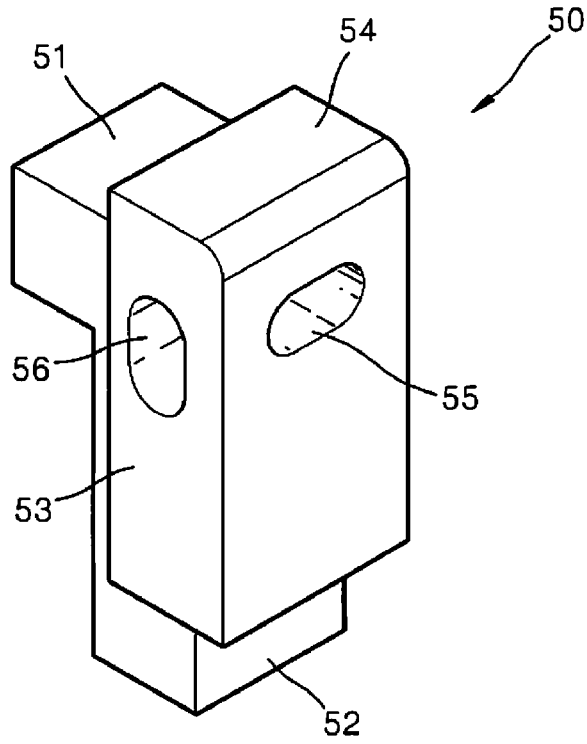
[figure 8A]
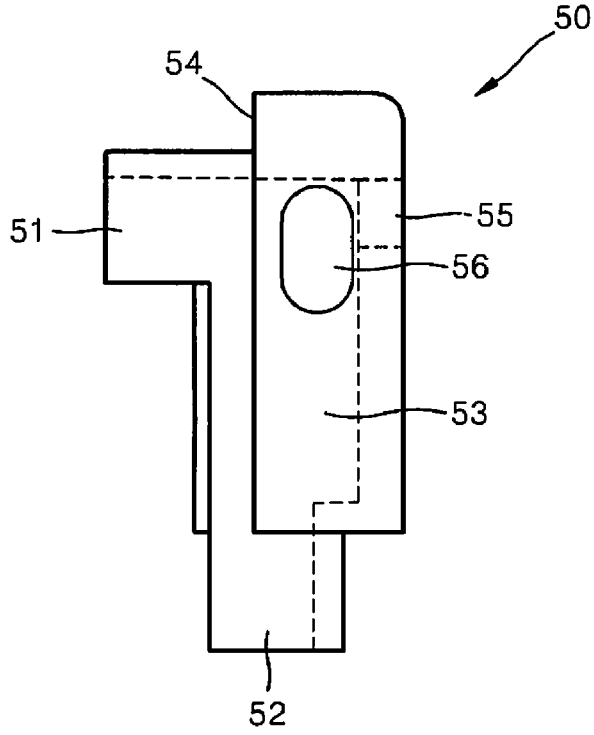

[figure 8B]
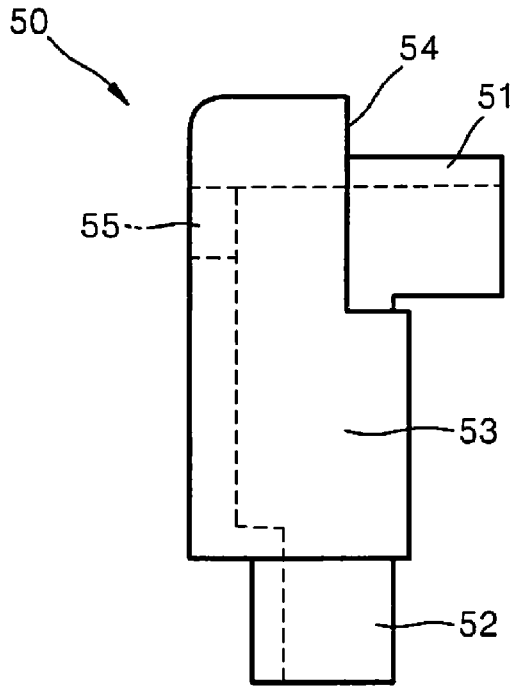
[figure 8C]
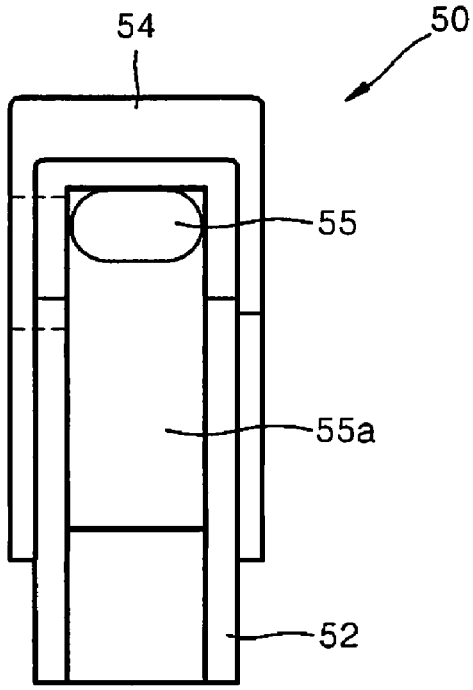

[figure 8D]
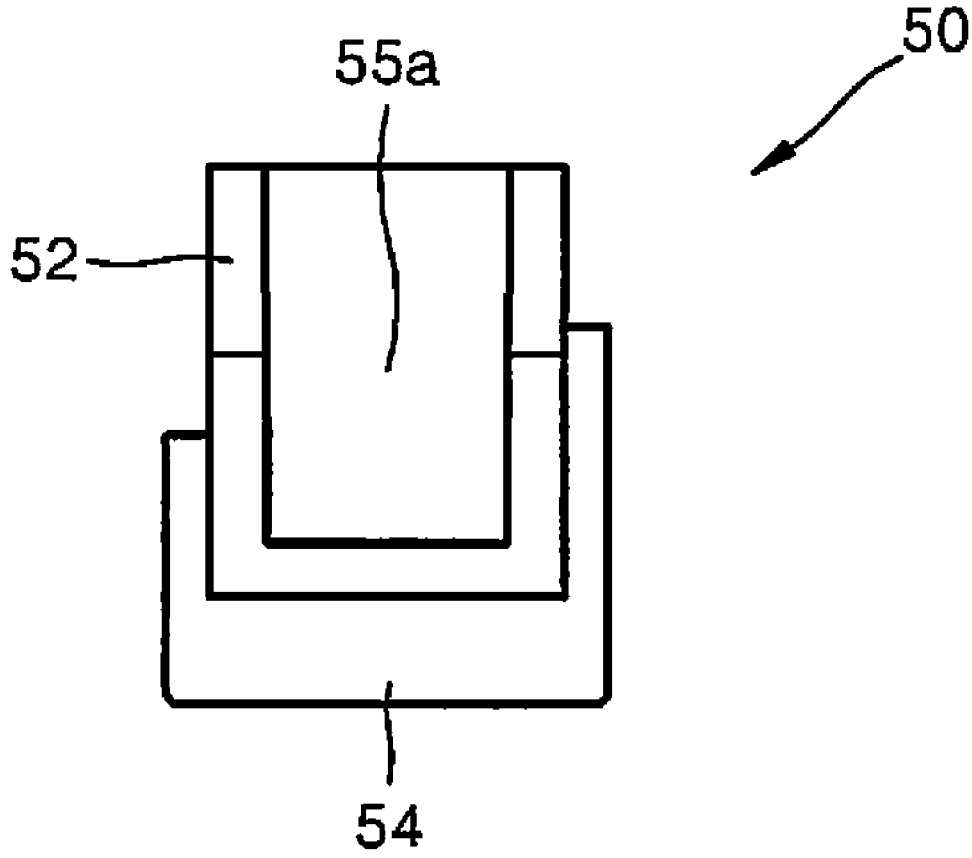

LED LIGHT BOARD

CROSS-REFERENCE TO RELATED PATENT APPLICATION

This application claims the benefit of Korean Patent Application No. 10-2010-0101678, filed on Oct. 19, 2010, in the Korean Intellectual Property Office, the disclosure of which is incorporated herein in its entirety by reference.

BACKGROUND OF THE INVENTION

1. Field of the Invention

The present invention relates to a light emitting diode (LED) light board, and more particularly, to an LED light board which includes finished corner portions to prevent a worker from being injured during manufacturing and construction of the LED light board.

2. Description of the Related Art

Light emitting diode (LED) light boards on which an LED as a new illumination device is used as a light source, have been recently developed and used. LED light boards include a light guide panel (LGP) to which a diffusion plate is closely adhered, an LED module disposed to be closely adhered to a lateral portion of the LGP and including a plurality of LEDs, and a frame for fixing the LED module to be closely adhered to the LGP. In this regard, the frame is implemented when cut portions of a frame fragment including corner portions that are cut at an angle of 45 degrees are closely adhered to each other.

However, in LED light boards, the corner portions of the frame are very sharp. Thus, there is a large probability that a work may be injured due to the corner portions of the frame during manufacturing or construction of LED light boards. In addition, since the corner portions of the frame are not cleanly finished, the appearance of LED light boards is not good.

SUMMARY OF THE INVENTION

The present invention provides a light emitting diode (LED) light board in which corner portions of a frame of the LED light board are smoothly finished so that a worker can be prevented from being injured due to the corner portions of the frame during manufacturing and construction of the LED light board and the value of the LED light board as a product can be improved.

The present invention also provides an LED light board in which a first frame and a second frame are easy to assemble by using a corner finishing end so that productivity can be improved.

According to an aspect of the present invention, there is provided a light emitting diode (LED) light board including: a light guide panel (LGP) shaped as a rectangle for inducing a path and scattering of light; an LED module disposed at a lateral side of the LGP and including a plurality of LEDs for irradiating light; a first frame having the LED module embedded therein and coupled to one side of an edge of the LGP; a second frame coupled to the other side of the edge of the LGP perpendicular to both ends of the first frame; and a corner finishing end on which the first frame and the second frame are connected to each other and corners of the first frame and the second frame are finished, wherein the first frame includes a first sidewall formed at one side of an edge of the LGP, a first upper wing bent on an end of the first sidewall, and a first lower wing bent on the other end of the first sidewall, having a larger width than that of the first upper wing and attached to one bottom surface of the edge of the LGP, and the second frame includes a second sidewall formed at the other side of an edge of the LGP, a second upper wing bent on an end of the second sidewall, and a second lower wing bent on the other end of the second sidewall, having a larger width than that of the second upper wing and attached to the other bottom surface of the edge of the LGP, and both ends of each of the first frame and the second frame are cut to be perpendicular to each other, and in order to assemble the first and second frames in the form of a rectangular frame, when an end of a pair of second lower wings is disposed close to a side of a pair of first lower wings, a gap space is formed between the first upper wing and the second upper wing, and the corner finishing end includes a first insertion end inserted between the first sidewall and the first upper and lower wings, a second insertion end inserted between the second sidewall and the second upper and lower wings, and a gap space finishing portion that closes the gap space between the first upper wing and the second upper wing when the first and second insertion ends are inserted into the first and second frames, respectively, and simultaneously forms the same surface as the surface of the first and second upper wings.

The corner finishing end may further include an end finishing portion that protrudes from an end portion of the first insertion end by a thickness of the first sidewall and the first upper and lower wings and finishes end portions of the first sidewall and the first upper and lower wings and not to be exposed when the first insertion end is inserted into the first frame.

The corner finishing end may further include an electric wire groove which is formed in the corner finishing end and through which an electric wire is connected to the LED module, and a first electric wire insertion hole which is formed in the end finishing portion and communicates with the electric wire groove.

The corner finishing end may further include a second electric wire insertion hole which is formed in the gap space finishing portion and communicates with the electric wire groove.

BRIEF DESCRIPTION OF THE DRAWINGS

The above and other features and advantages of the present invention will become more apparent by describing in detail exemplary embodiments thereof with reference to the attached drawings in which:

FIG. 1 is a perspective view of a light emitting diode (LED) light board according to an embodiment of the present invention;

FIG. 2 is a perspective view of a corner finishing end on which a first frame and a second frame of the LED light board illustrated in FIG. 1 are connected to each other;

FIG. 3 is an enlarged perspective view of the first frame, the second frame, and the corner finishing end illustrated in FIG. 2;

FIG. 4 is a cross-sectional view of the LED light board of FIG. 1;

FIG. 5 is a front view for illustrating a gap space formed in corner portions of the first frame and the second frame;

FIG. 6 is a rear view of FIG. 5;

FIG. 7 is a perspective view of a corner finishing end on which the first frame and the second frame are connected to each other; and FIG. 8A is a front view of the corner finishing end of FIG. 7, and FIG. 8B is a rear view of the corner finishing end of FIG. 7, and FIG. 8C is a plan view of the corner finishing end of FIG. 7, and FIG. 8D is a bottom view of the corner finishing end of FIG. 7.

DETAILED DESCRIPTION OF THE INVENTION

The present invention will now be described more fully with reference to the accompanying drawings, in which exemplary embodiments of the invention are shown.

FIG. 1 is a perspective view of a light emitting diode (LED) light board according to an embodiment of the present invention, and FIG. 2 is a perspective view of a corner finishing end on which a first frame and a second frame of the LED light board illustrated in FIG. 1 are connected to each other, and FIG. 3 is an enlarged perspective view of the first frame, the second frame, and the corner finishing end illustrated in FIG. 2, and FIG. 4 is a cross-sectional view of the LED light board of FIG. 1, and FIG. 5 is a front view for illustrating a gap space formed in corner portions of the first frame and the second frame, and FIG. 6 is a rear view of FIG. 5, and FIG. 7 is a perspective view of a corner finishing end on which the first frame and the second frame are connected to each other, and FIG. 8A is a front view of the corner finishing end of FIG. 7, and FIG. 8B is a rear view of the corner finishing end of FIG. 7, and FIG. 8C is a plan view of the corner finishing end of FIG. 7, and FIG. 8D is a bottom view of the corner finishing end of FIG. 7.

As illustrated in FIG. 1, the LED light board according to the current embodiment of the present invention includes: a light guide panel (LGP) 10 shaped as a rectangle for inducing a path and scattering of light; an LED module 20 disposed at a lateral side of the LGP 10 and including a plurality of LEDs 21 for irradiating light; a first frame 30 having the LED module 20 embedded therein and coupled to one side of an edge of the LGP 10; a second frame 40 coupled to the other side of the edge of the LGP 10 perpendicular to both ends of the first frame 30; and a corner finishing end 50 on which the first frame 30 and the second frame 40 are connected to each other and corners of the first frame 30 and the second frame 40 are finished.

The LGP 10 is formed of an acryl plate through light transmits, and a pattern is formed at one side of the LGP 10 so as to induce a path and scattering of light. A diffusion plate and a reflection layer are stacked on the LGP 10. The LGP 10 passes through first and second upper wings 32 and 42 of the first and second frames 30 and 40 coupled to each other in the form of a rectangular frame that will be described later and then, an edge of the LGP 10 is attached to first and second lower wings 33 and 43 by using a double-sided adhesive tape T.

The LED module 20 is implemented when the LEDs 21 are arranged on a band-shaped printed circuit board (PCB) substrate 22 at regular intervals. In the present embodiment, the LED module 20 is installed inside a pair of first frames 30, respectively. However, the LED module 20 may also be installed inside a pair of second frames 40.

The first frame 30 is formed of metal so as to enable heat radiation and may be formed of aluminum. The first frame 30 includes a first sidewall 31 formed at one side of an edge of the LGP 10, a first upper wing 32 bent on an end of the first sidewall 31, and a first lower wing 33 bent on the other end of the first sidewall 31, having a larger width than that of the first upper wing 32 and attached to one bottom surface of the edge of the LGP 10. Both ends of the first frame 30 are cut to be perpendicular to each other.

The second frame 40 is formed of metal so as to enable heat radiation and may be formed of aluminum. The second frame 40 includes a second sidewall 41 formed at the other side of an edge of the LGP 10, a second upper wing 42 bent on an end of the second sidewall 41, and a second lower wing 43 bent on the other end of the second sidewall 41, having a larger width than that of the second upper wing 42 and attached to the other bottom surface of the edge of the LGP 10. Both ends of the second frame 40 are cut to be perpendicular to each other.

When the first and second frames 30 and 40 are coupled to each other in the form of a rectangular frame through the structure of the first and second frames 30 and 40, the LGP 10 passes through the first and second upper wings 32 and 42 and then, both bottom surfaces of the edge of the LGP 10 are attached to the first and second lower wings 33 and 43 by using the double-sided adhesive tape T, as illustrated in FIG. 4.

On the other hand, both ends of each of the first and second frames 30 and 40 are cut perpendicular to each other, and each of the first and second frames 30 and 40 has the first and second lower wings 33 and 43 having larger widths than those of the first and second upper wings 32 and 42. Thus, in order to assemble the first and second frames 30 and 40 in the form of a rectangular frame, when an end of a pair of second lower wings 43 is disposed close to a side of a pair of first lower wings 33, a gap space S is formed between the first upper wing 32 and the second upper wing 42, as illustrated in FIGS. 3 and 5. The gap space S is closed when the corner finishing end 50 is coupled to the first and second frames 30 and 40.

To this end, the corner finishing end 50 includes: a first insertion end 51 inserted into an end of the first frame 30, specifically, between the first sidewall 31 and the first upper and lower wings 32 and 33; a second insertion end 52 inserted into an end of the second frame 40, specifically, between the second sidewall 41 and the second upper and lower wings 42 and 43; and a gap space finishing portion 53 that closes the gap space S between the first upper wing 32 and the second upper wing 42 when the first and second insertion ends 51 and 52 are inserted into the first and second frames 30 and 40, respectively, and simultaneously forms the same surface as the surface of the first and second upper wings 32 and 42. In this case, the first insertion end 51 and the second insertion end 52 have protruded shapes. However, a length at which each of the first and second insertion ends 51 and 52 protrudes, may be variable according to the specification of the first and second frames 30 and 40, as illustrated in FIG. 7 and FIGS. 8A through 8D.

In addition, the corner finishing end 50 further includes an end finishing portion 54 that protrudes from an end portion of the first insertion end 51 by a thickness of the first sidewall 31 and the first upper and lower wings 32 and 33 and finishes end portions of the first sidewall 31 and the first upper and lower wings 32 and 33 not to be exposed when the first insertion end 51 is inserted into the first frame 30.

In addition, the corner finishing end 50 further includes an electric wire groove 55*a* which is formed in the corner finishing end 50 and through which an electric wire w is connected to the LED module 20, and a first electric wire insertion hole 55 which is formed in the end finishing portion 54 and communicates with the electric wire groove 55*a*. The electric wire w that has passed through the first electric wire insertion hole 55 passes through the electric wire groove 55*a* and then is connected to the LED module 20 via the LGP 10 and the first and second sidewalls 31 and 41.

In addition, the corner finishing end 50 further includes a second electric wire insertion hole 56 which is formed in the gap space finishing portion 53 and communicates with the electric wire groove 55*a*. The second electric wire insertion hole 56 is used to allow an electric wire to be pulled out of the rear side of the LED light board when several LED light boards according to the present invention are closely adhered to one another. Thus, the electric wire for connecting each LED light board is disposed at a rear side of the LED light board and is not exposed in a front direction in which light is irradiated.

The corner finishing end 50 may be formed of resin, such as plastic, and corner portions of the first and second frames 30 and 40 are connected to each other by using the corner finishing end 50 so that corner portions of the LED light board can be smoothly finished.

In this manner, in the LED light board according to the present invention, the gap space S formed when the first and second frames 30 and 40 including the first and second lower wings 33 and 43 having larger widths than those of the first and second upper wings 32 and 42 assemble, is filled, and simultaneously, corner portions of a finished product can be cleanly finished so that a worker can be prevented from being injured during manufacturing and construction of the LED light board. Furthermore, the value of the LED light board including the finished corner portions according to the present invention, as a product can be improved.

As described above, in an LED light board according to the present invention, corner portions in which a first frame and a second frame are coupled to each other, are smoothly finished so that a work can be prevented from being injured during manufacturing and construction of the LED light board.

In addition, since the first frame and the second frame can assemble by using a corner finishing end, assembling can be easily performed, and productivity can be improved.

Furthermore, when several LED light boards can be closely adhered to one another, electric wires for applying power to an LED module are pulled out of a rear side of the LED light board and are connected to each other so that the electric wires can be prevented from being exposed to a front side of the LED light board.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A light emitting diode (LED) light board comprising:

a light guide panel (LGP) shaped as a rectangle for inducing a path and scattering of light;

an LED module disposed at a lateral side of the LGP and comprising a plurality of LEDs for irradiating light;

a first frame having the LED module embedded therein and coupled to one side of an edge of the LGP;

a second frame coupled to the other side of the edge of the LGP perpendicular to both ends of the first frame; and a corner finishing end on which the first frame and the second frame are connected to each other and corners of the first frame and the second frame are finished, wherein the first frame comprises a first sidewall formed at one side of an edge of the LGP, a first upper wing bent on an end of the first sidewall, and a first lower wing bent on the other end of the first sidewall, having a larger width than that of the first upper wing and attached to one bottom surface of the edge of the LGP, and the second frame comprises a second sidewall formed at the other side of an edge of the LGP, a second upper wing bent on an end of the second sidewall, and a second lower wing bent on the other end of the second sidewall, having a larger width than that of the second upper wing and attached to the other bottom surface of the edge of the LGP, and both ends of each of the first frame and the second frame are cut to be perpendicular to each other, and in order to assemble the first and second frames in the form of a rectangular frame, when an end of a pair of second lower wings is disposed close to a side of a pair of first lower wings, a gap space is formed between the first upper wing and the second upper wing, and the corner finishing end comprises a first insertion end inserted between the first sidewall and the first upper and lower wings, a second insertion end inserted between the second sidewall and the second upper and lower wings, and a gap space finishing portion that closes the gap space between the first upper wing and the second upper wing when the first and second insertion ends are inserted into the first and second frames, respectively, and simultaneously forms the same surface as the surface of the first and second upper wings.

2. The LED light board of claim 1, wherein the corner finishing end further comprises an end finishing portion that protrudes from an end portion of the first insertion end by a thickness of the first sidewall and the first upper and lower wings and finishes end portions of the first sidewall and the first upper and lower wings and not to be exposed when the first insertion end is inserted into the first frame.

3. The LED light board of claim 2, wherein the corner finishing end further comprises an electric wire groove which is formed in the corner finishing end and through which an electric wire is connected to the LED module, and a first electric wire insertion hole which is formed in the end finishing portion and communicates with the electric wire groove.

4. The LED light board of claim 3, wherein the corner finishing end further comprises a second electric wire insertion hole which is formed in the gap space finishing portion and communicates with the electric wire groove.

* * * * *

UNITED STATES PATENT AND TRADEMARK OFFICE

CERTIFICATE OF CORRECTION

PATENT NO. : 8,235,575 B2
APPLICATION NO. : 13/183236
DATED : August 7, 2012
INVENTOR(S) : Moon-Soo Kim It is certified that error appears in the above-identified patent and that said Letters Patent is hereby corrected as shown below:

In title page, item (30) Foreign Application Priority Data, insert:

--October 19, 2010 (KR).....10-2010-0101678--

Signed and Sealed this
Twenty-seventh Day of November, 2012

David J. Kappos

David J. Kappos
*Director of the United States Patent and Trademark Office*